US010237921B2

(12) United States Patent
Lu

(10) Patent No.: US 10,237,921 B2
(45) Date of Patent: Mar. 19, 2019

(54) CYLINDRICAL HEATER

(71) Applicant: Momentive Performance Materials Inc., Waterford, NY (US)

(72) Inventor: Zhong-Hao Lu, Twinsburg, OH (US)

(73) Assignee: Momentive Performance Materials Inc., Waterford, NY (US)

( * ) Notice: Subject to any disclaimer, the term of this patent is extended or adjusted under 35 U.S.C. 154(b) by 311 days.

(21) Appl. No.: 15/074,286

(22) Filed: Mar. 18, 2016

(65) Prior Publication Data

US 2017/0273145 A1 Sep. 21, 2017

(51) Int. Cl.

| | |
|---|---|
| ***H05B 3/48*** | (2006.01) |
| ***H05B 3/00*** | (2006.01) |
| ***H05B 3/14*** | (2006.01) |
| ***H05B 3/42*** | (2006.01) |

(52) U.S. Cl.

CPC ..... *H05B 3/48* (2013.01); *H05B 3/0014* (2013.01); *H05B 3/145* (2013.01); *H05B 3/42* (2013.01); *H05B 2203/004* (2013.01); *H05B 2203/005* (2013.01); *H05B 2203/017* (2013.01); *H05B 2203/037* (2013.01)

(58) Field of Classification Search

CPC ..... H05B 3/48; H05B 3/0014; H05B 3/145; H05B 3/42; H05B 2203/004; H05B 2203/005; H05B 2203/017; H05B 2203/037; H05B 3/62; H05B 2203/002; H05B 2203/003; H05B 3/362; H05B 3/44

See application file for complete search history.

(56) References Cited

U.S. PATENT DOCUMENTS

| | | | |
|---|---|---|---|
| 3,152,006 | A | 10/1964 | Basche |
| 5,343,022 | A | 8/1994 | Gilbert, Sr. et al. |
| 6,410,172 | B1 | 6/2002 | Gilbert, Sr. |

(Continued)

FOREIGN PATENT DOCUMENTS

| | | | |
|---|---|---|---|
| DE | 3531455 | A1 | 4/1986 |
| GB | 1263842 | A | 2/1972 |

(Continued)

OTHER PUBLICATIONS

Patent Cooperation Treaty (PCT), International Search Report and Written Opinion for Application PCT/US2017/017853 filed Feb. 15, 2017, dated Jul. 7, 2017, International Searching Authority, EP.

*Primary Examiner* — Shawntina Fuqua
(74) *Attorney, Agent, or Firm* — Joseph Waters; McDonald Hopkins LLC

(57) ABSTRACT

A heater assembly is disclosed herein. The heater assembly may comprise a tubular body. The tubular body may include a graphite core disposed in a heating path. The graphite core may be coated with an overcoat layer. The tubular body may include slits that may cut-off heat transfer between portions of the tubular body. The heater assembly may have a configuration comprising a plurality of heating rungs having a predominant portion disposed substantially perpendicular to an upper surface of the heater so that the predominant portion is disposed vertically. The heater assembly may include a flange at a first end and a lip at a second end. The heater assembly configuration provides a heater that exhibits reduced thermal stress and/or reduced CTE mismatch stress particularly compared to other designs.

19 Claims, 13 Drawing Sheets

(56) References Cited

U.S. PATENT DOCUMENTS

| | | | |
|---|---|---|---|
| 7,259,358 | B2 | 8/2007 | Mariner et al. |
| 7,458,659 | B2 | 12/2008 | Seok et al. |
| 7,741,584 | B2 | 6/2010 | Mariner |
| 2012/0312800 | A1 | 12/2012 | Chartier et al. |

FOREIGN PATENT DOCUMENTS

| | | | | |
|---|---|---|---|---|
| JP | 2013-118088 | A2 | | 6/2013 |
| WO | 2015/009538 | | * | 1/2015 |
| WO | 2015-009538 | A1 | | 1/2015 |

* cited by examiner

CYLINDRICAL HEATER

FIELD OF INVENTION

The present invention relates to a heater assembly. In particular, the present invention relates to a coated graphite heater assembly configuration suitable for a wide variety of applications including, but not limited to, heating a semiconductor wafer in a semiconductor processing device.

BACKGROUND

In the fabrication of a semiconductor device or semiconductor material, a semiconductor wafer is processed in an enclosure defining a reaction chamber at a relatively high temperature (e.g., above 1000° C.), with the wafer being placed adjacent to or in contact with a resistive heater coupled to a power source. For a cylindrical heater, the wafer can be placed on a support and the support can be heated by the heater. In this process, the heater attempts to hold the temperature of the semiconductor wafer substantially constant and uniform, varying in the range of about 1° C. to 10° C.

U.S. Pat. No. 5,343,022 discloses a heating unit for use in a semiconductor wafer processing process, comprising a heating element of pyrolytic graphite ("PG") superimposed on a pyrolytic boron nitride base. The graphite layer is machined into a spiral or serpentine configuration defining the area to be heated, with two ends connected to a source of external power. The entire heating assembly is then coated with a pyrolytic boron nitride ("PBN") layer. U.S. Pat. No. 6,410,172 discloses a heating element, wafer carrier, or electrostatic chuck comprising a PG element mounted on a PBN substrate, with the entire assembly being subsequently CVD coated with an outer coating of AlN to protect the assembly from chemical attacks.

Although graphite is a refractory material that is economical and temperature resistant, graphite is corroded by some of the wafer processing chemical environments, and it is prone to particle and dust generation. Due to the discontinuous surface of a conventionally machined graphite heater, the power density varies dramatically across the area to be heated. Moreover, a graphite body, particularly after machining into a serpentine geometry, is fragile and its mechanical integrity is poor. Accordingly, even with a relatively large cross-sectional thickness, e.g., above about 0.1 inches as typical for semiconductor graphite heater applications, the heater is still extremely weak and must be handled with care. Furthermore, a graphite heater changes dimension over time due to annealing which induces bowing or misalignment, resulting in an electrical short circuit. It is also conventional in semiconductor wafer processing to deposit a film on the semiconductor which may be electrically conductive. Such films may deposit as fugitive coatings on the heater, which can contribute to an electrical short circuit, a change in electrical properties, or induce additional bowing and distortion.

One approach to improving the stability of graphite heaters is to coat the graphite body with a nitride such as boron nitride or provide boron nitride bridges between heating elements. These designs might still exhibit high stress from coefficient of thermal expansion (CTE) mismatch stress (between the graphite and boron nitride material) and thermal stress at elevated operating temperatures. High stress can result in early failure in the heating device.

In another aspect, these graphite heaters often have irregular heat signatures throughout the heaters.

SUMMARY

The following presents a summary of this disclosure to provide a basic understanding of some aspects. This summary is intended to neither identify key or critical elements nor define any limitations of embodiments or claims. Furthermore, this summary may provide a simplified overview of some aspects that may be described in greater detail in other portions of this disclosure.

The present disclosure provides a heater assembly for controlled heating of an object. The heater assembly comprises a conductive core that may comprise a pyrolytic graphite material. The core may be shaped into a desired heating path. The core may be coated with a protective layer. The protective layer may comprise a pyrolytic boron nitride. The heater assembly may comprise a generally tubular or cylindrical body. The body may comprise a flange at a first end and a lip at a second end. One or more slits or apertures may be disposed through the body. The slits may cut-off heat transfer between an upper body to a lower body.

In at least one aspect, a heating path may comprise a predetermined path, such as a serpentine pattern. The serpentine pattern may comprise a continuous pattern having a plurality of rungs. Predominant sides of the rungs may be vertically, horizontally, or otherwise oriented based on a desired heating profile. Subordinate sides may electrically connect predominant sides of the rungs. The subordinate sides may include exaggerated bends that may add separation or distance between rungs in comparison with non-exaggerated bends. The exaggerated bends may be "Y-shaped," "T-shaped," or the like.

In at least one aspect, a heater assembly may include a lip at a distal end. The lip may be configured to receive a device (e.g., a support) or material, such as a susceptor. The susceptor may be configured to receive a wafer for heating. The lip may provide for an even or generally uniform heating profile at a distal end of the heater assembly.

The following description and the drawings disclose various illustrative aspects. Some improvements and novel aspects may be expressly identified, while others may be apparent from the description and drawings.

BRIEF DESCRIPTION OF THE DRAWINGS

The accompanying drawings illustrate various systems, apparatuses, devices and related methods, in which like reference characters refer to like parts throughout, and in which.

DETAILED DESCRIPTION

Figure 1A:
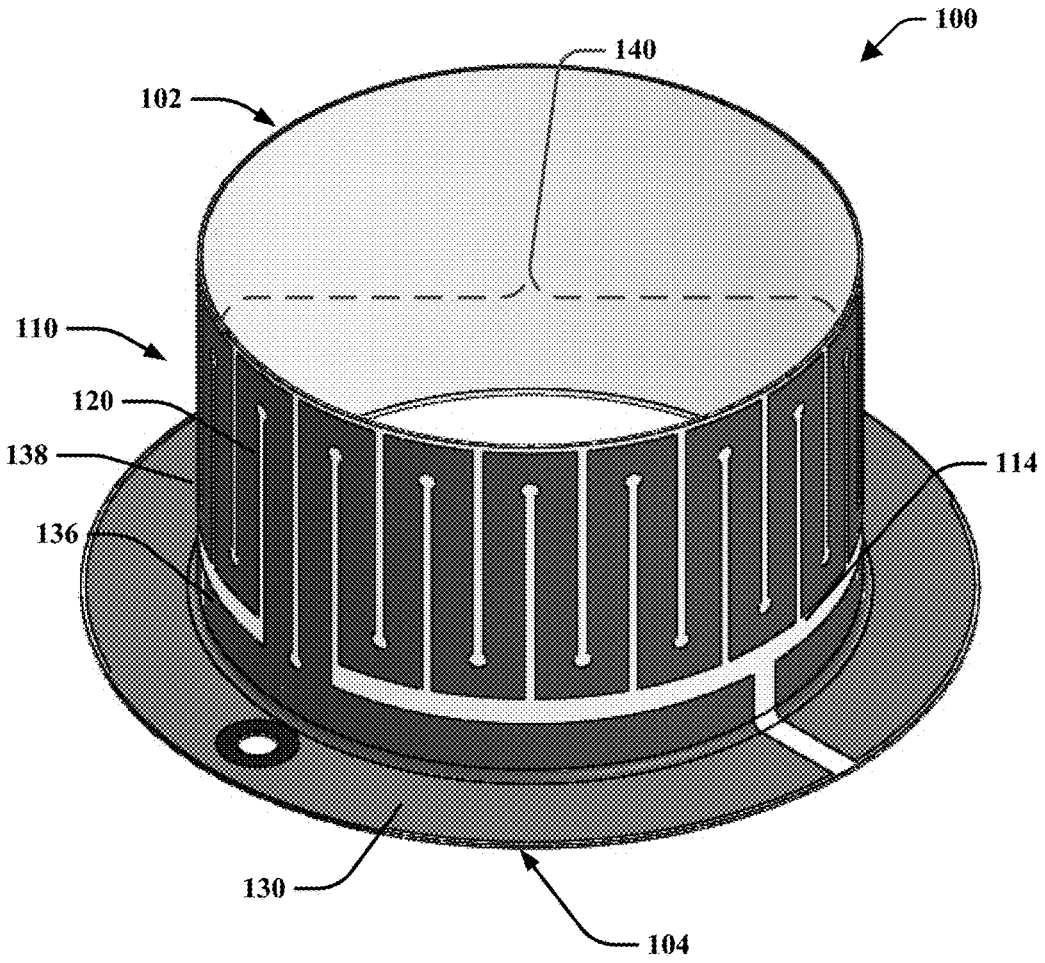
FIG. 1A illustrates a perspective view of a heater assembly in accordance with an embodiment disclosed herein

Reference will now be made to exemplary embodiments, examples of which are illustrated in the accompanying drawings. It is to be understood that other embodiments may be utilized and structural and functional changes may be made. Moreover, features of the various embodiments may be combined or altered. As such, the following description is presented by way of illustration only and should not limit in any way the various alternatives and modifications that may be made to the illustrated embodiments. In this disclosure, numerous specific details provide a thorough understanding of the subject disclosure. It should be understood that aspects of this disclosure may be practiced with other embodiments not necessarily including all aspects described herein, etc.

As used herein, the words "example" and "exemplary" mean an instance, or illustration. The words "example" or "exemplary" do not indicate a key or preferred aspect or embodiment. The word "or" is intended to be inclusive rather than exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

While embodiments described herein refer to a tube or cylindrical heater assembly, it is noted that embodiments can include differently shaped heaters. For instance, embodiments may comprise shapes that generally represent a cylinder, an N-sided prism (e.g., where N is a number), a cone (or portion thereof), and the like. Furthermore, such heater assemblies may be utilized for a variety of applications, such as, but not limited to, fabrication of a semiconductor wafer.

In some traditional heaters, the heaters may include a BN body or a PBN coated graphite heater. These heaters may include PBN bridges between heating elements. However, such heaters may have high stress, both from CTE mismatch stress at room temperature and thermal stresses in elevated operating temperatures. In another aspect, such heaters may not manage thermal energy according to a desired heat profile. For instance, a distal end (e.g., top and/or bottom depending on a design) may have a lower temperature than other portions. The temperature variations may result in an inconsistent temperature profile.

Various embodiments described herein relate to a heater assembly that can facilitate generation and/or transfer of heat. The heater assemblies may have a configuration adapted to relieve thermal stress, relieve CTE mismatch stress, comprise robust designs of various dimensions, and generate more uniform temperature profiles with respect to other heaters. For instance, a heater assembly may comprise a graphite core coated with one or more layers of a nitride, a carbide, a carbonitride, an oxynitride, or the like.

The graphite core may have a configuration defining a path for flow of electrical current. In an aspect, the path may comprise a predetermined pattern, such as a serpentine pattern. The pattern may be configured to achieve a desired heating profile. For example, the pattern may be configured to evenly distribute heat throughout the heater apparatus.

The graphite core may be coated with one or more layers. In at least one embodiment, the graphite core may be coated with a first coating layer and a second coating layer. The coating layers may comprise at least one of a nitride, a carbide, a carbonitride, or an oxynitride of elements selected from a group consisting of B, Al, Si, Ga, refractory hard metals, transition metals, and rare earth metals, or a combination of two or more thereof. According to another aspect, the coating layers may comprise at least one of a PBN, aluminum nitride, titanium aluminum nitride, titanium nitride, titanium aluminum carbonitride, titanium carbide, silicon carbide, and silicon nitride. It is noted that the first and second coating layers may comprise the same, similar, or different materials.

Disclosed heater assemblies may comprise a flange or mounting base. The flange may generally circumscribe a first end of a body of a heater assembly and/or extend therefrom. The flange may comprise one or more electrical contacts. A power source may be connected to the one or more electrical contacts. Power may flow through the electrical contacts and the heating path defined by the graphite core. A second end of the body may comprise a lip or ledge. The lip may increase radiation heat transfer to a desired material, in comparison with an end that does not comprise a lip. In an aspect, the desired material may be a material to be heated, such as a susceptor material, which may hold or support a wafer. The wafer may be a silicon wafer or the like. While embodiments describe heating of a wafer for exemplary purposes, it is noted that disclosed embodiments may be utilized to heat other materials or subjects.

In an embodiment, the body of the heater may comprise one or more apertures that may be formed through one or more of the first coating layer, the second coating layer, and/or the graphite core. The apertures may be configured to cut-off or disrupt heat sink and generate a similar temperature provided as a PBN coated graphite heater. The apertures may comprise one or more slits disposed proximal to the flange. The slits may reduce or cut-off heat lost to the flange.

In another aspect, the apertures may be configured to maintain the temperature of an area proximal to and/or including the flange at or below a threshold temperature.

In an exemplary embodiment, a heater assembly may comprise a body that includes a PBN base layer (e.g., first coating layer) that is deposited or otherwise formed into a cylindrical shape. A PG layer (e.g., graphite core) may be superimposed to the PBN base layer. The PG layer may be patterned to form or define an electrode or current path. For instance, the PG layer may be patterned as a continuous path comprising a plurality of heating rungs. The heating rungs may have a major portion that is oriented substantially perpendicular to a flange of the body and minor portions that may be substantially parallel to the flange. In another aspect, a PBN overcoat layer may be superimposed on the PG layer and at least a portion of the PBN base coat. The PBN/PG/PBN heater assembly may be configured in a desired shape, such as a generally tubular or cylindrical shape. It is noted that references to layers, coats, a base, or the like do not necessitate nor imply a preferred method of forming heater assemblies disclosed herein. For instance, while this disclosure may refer to a layer or coating of PBN, it is noted that embodiments may comprise multiple layers or coatings, layers formed at different times or steps in a manufacturing process, or the like.

A lip may be formed at an end of the body that is distal to the flange. For instance, the heater assembly may be placed within and/or comprise a crucible. A power source may be connected to electrical contacts of the heater assembly. Power may be supplied to the heating assembly and the heating rungs may radiate heat. A user or the like may place a material to be heated within a cavity defined by the body. The heater assembly may heat the material to a desired temperature. The heater assembly may comprise a graphite core having a configuration defining a predetermined path defining a plurality of heating rungs. The heater can be an integral body where the path can be a continuous path comprising a plurality of heating rungs. In one embodiment, the heater comprises a graphite body comprising two halves connected in series or in parallel, where each half comprises a plurality of heating rungs in a predetermined configuration. In at least one embodiment, the body comprises two halves connected in series or in parallel, where each half has a configuration defining a predetermined path defining a plurality of heating rungs, where the heating rungs have a major or predominant portion oriented substantially parallel to the upper surface of the body.

In an embodiment of the invention, each heating rung has substantially the same width. In another embodiment, the width of at least one heating rung may be narrower than the width of at least one other heating rung. The width of the uppermost heating rung at the top of the upper surface of the body may be narrower than at least one other heating rung. In another embodiment, the width of the uppermost heating rung at the top of the upper surface of the body is less than or equal to half the width of at least one other heating rung. In another aspect of the invention, the heater assembly comprises a coated graphite body. The coated graphite body has an upper surface and a lower surface. The body may have a configuration defining a predetermined path defining a plurality of heating rungs, wherein a major portion of each heating rung is oriented substantially parallel to the upper surface. The width of at least one heating rung is narrower than the width of another heating rung.

A heater or an apparatus having a heater printed thereon in accordance with aspects of the present technology may be suitable for use in a wide range of applications. The heater comprising a plurality of heater elements with different power density gradients are particularly suitable for applications where it is desirable to provide precise control of the heating profile and to allow for change of the heating profile by changing the power applied to the different heating zones or electrode paths. Applications where the heater assembly or a container comprising the heater assembly are suitable include, but are not limited to, molecular beam epitaxial applications, metal evaporation, thermal evaporation, solar cell growth, metal organic chemical vapor deposition (MOCVD), plasma enhanced chemical vapor deposition (PECVD), organometallic chemical vapor deposition (OMCVD), metal organic vapor phase epitaxy (MOVPE), vertical gradient freeze (VGF) crystal growth processes, etc.

Figure 1B:
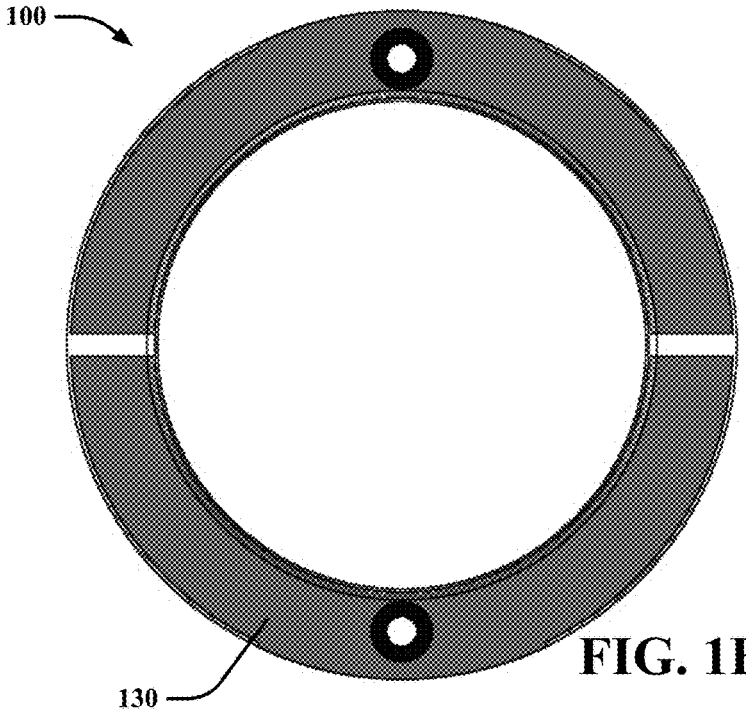
FIG. 1B illustrates a top view of the heater assembly of FIG. 1A.
Figure 1C:
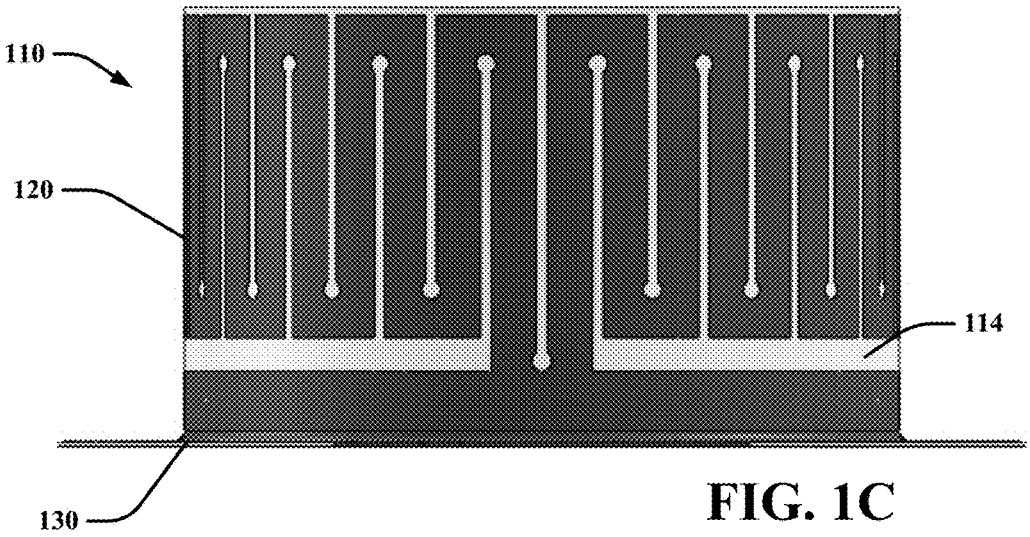
FIG. 1C illustrates a side view of the heater assembly of FIG. 1A.

FIGS. 1A-C illustrate an exemplary embodiment of a heater assembly 100 that may comprise a body 110 having a distal end 102 and a proximal end 104. The body 110 include a plurality of heating rungs 140 that form a heating path 120. In another aspect, body 110 may comprise a lower body 136, one or more body insulating areas 114, and an upper body 138. It is noted that the body insulating areas 114 are not cut-through. Body 110 may extend from a flange 130 towards distal end 102. At distal end 102 the body 110 may terminate, without a lip. It is noted that embodiments may include a lip as described herein. It is noted that the heater assembly 100 may have an uneven heat profile in comparison with disclosed embodiments. For instance, disclosed embodiments may include a lip at a distal end of a heater, one or more areas that are cut through, exaggerated bends in rungs, and the like.

Figure 2A:
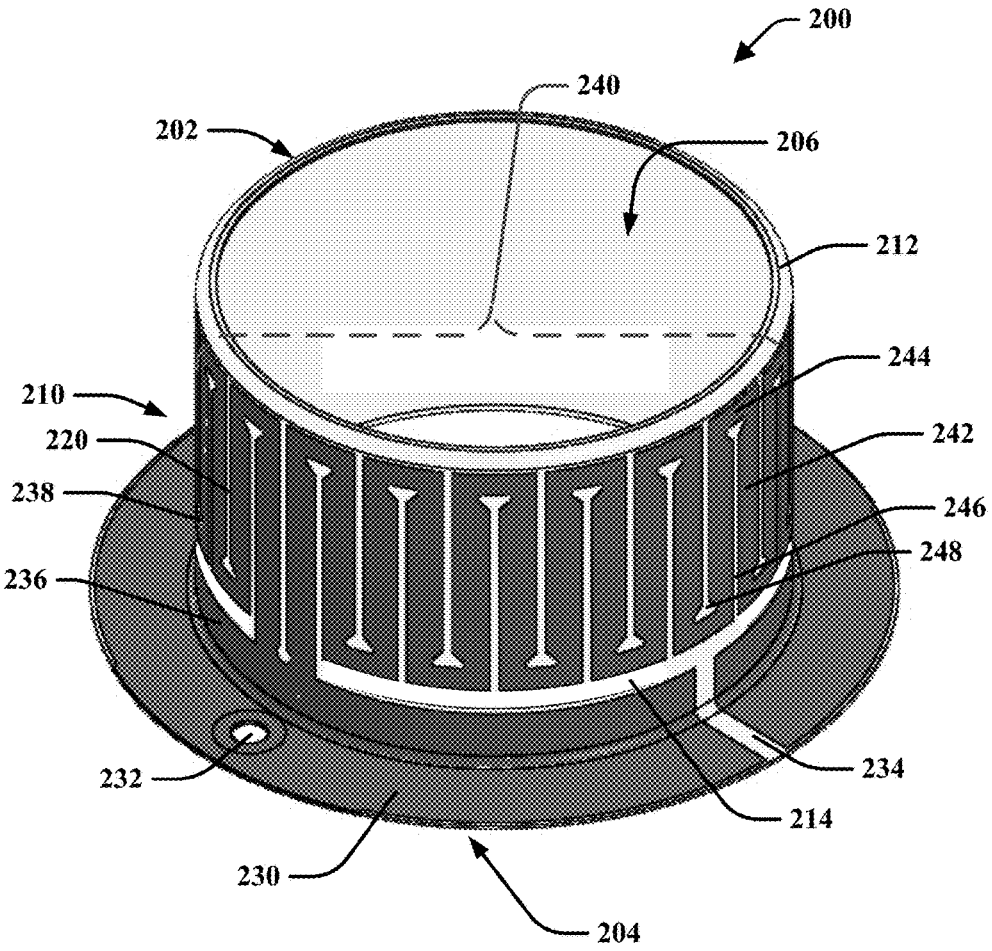
FIG. 2A is a perspective view of a heater assembly comprising exaggerated bends and a lip in accordance with an embodiment disclosed herein.
Figure 2B:
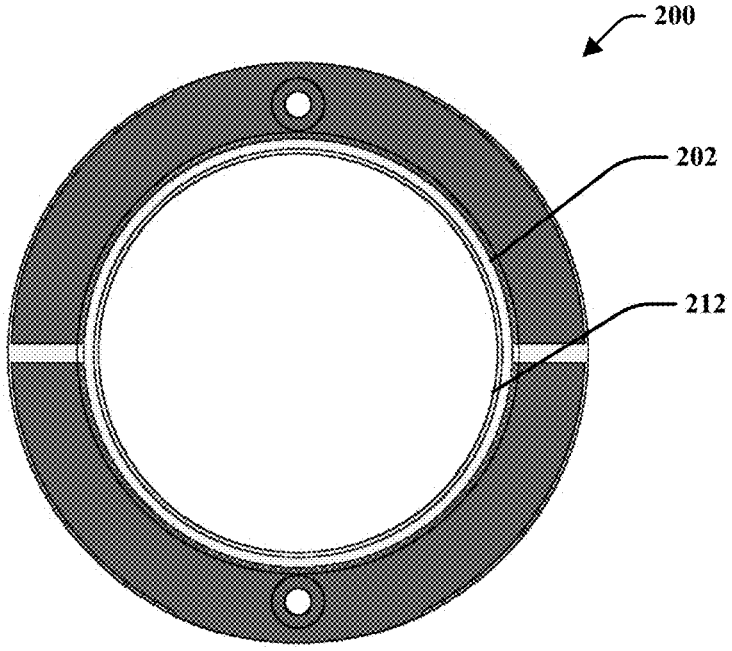
FIG. 2B illustrates a top view of the heater assembly of FIG. 2A.
Figure 2C:
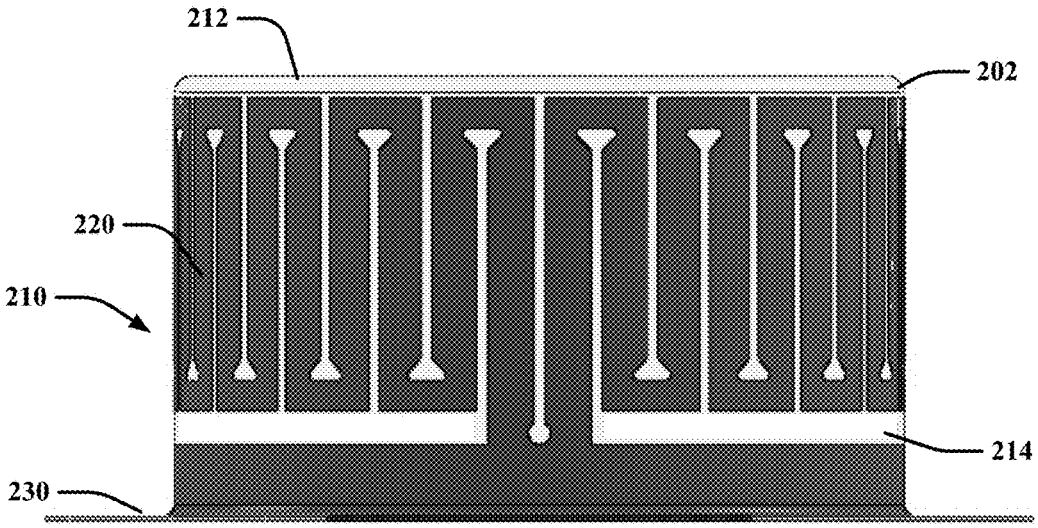
FIG. 2C illustrates a side view of the heater assembly of FIG. 2A.

FIGS. 2A-C illustrate an embodiment of a heater assembly 200 in accordance with aspects and embodiments of this disclosure. As depicted, heater assembly 200 may comprise a body 210 having a distal end 202 and a proximal end 204. The body 210 may comprise a lip 212 at a distal end 202, one or more horizontal insulating areas 214, and a heating path 220. A flange 230 may be disposed at or near proximal end 204. It is noted that heater assembly 200 can comprise other configurations and/or components not shown for sake of brevity. For instance, heater assembly 200 may comprise and/or be attachable to a crucible, susceptor, or the like.

The body 210 may comprise one or more layers of materials that form conducting or heating path 220. In an example, the body 210 may comprise a first layer or base coat. The base coat may comprise a PBN base coat. The PBN base coat may be superimposed with an intermediate layer or core that may comprise a PG layer. The PG layer may be formed to define the heating path 220. In an aspect, the PG layer may be patterned or formed in a desired pattern via chemical deposition, chemical etching, mechanical processes, or the like. The PG layer may be overcoated with a PBN layer. In at least one aspect, the base PBN layer and the PBN overcoat may generally cover the PG layer such that it is not exposed to an external atmosphere. It is noted that a portion of the PG layer may be exposed at or near an electrical contact. It is further noted that the body 210 can comprise a different number of layers, differently formed layers, or the like. In another aspect, the various different layers may be formed according to appropriate processes. The processes may include, for example, chemical deposition, chemical etching, mechanical etching, physical machining, molding (e.g., casting, etc.), or the like.

In an aspect, the heating path 220 may comprise one or more rungs 240. Each of the rungs 240 may comprise a predominant side 242 and a subordinate side 244. In at least one embodiment, the predominant side 242 may generally extend perpendicular with the distal end 202 and/or the proximal end 204. The subordinate side 244 may generally run parallel with the distal end 202 and/or the proximal end 204 (e.g., perpendicularly with the predominate side 242). In another aspect, the predominant side 242 may comprise a first length that is generally greater than a second length of the subordinate side 244. It is noted that various embodiments may comprise a predominant side 242 that is generally parallel with the distal end 202 and/or the proximal end 204. Likewise, the subordinate side 244 may be perpendicular with the predominant side 242, distal end 202, and/or the proximal end 204. It is further noted the predominant side 242 and subordinate side 244 may be generally equal in width.

Various embodiments may describe the rungs 240 as being arranged horizontally, vertically, or otherwise oriented in a direction. The direction may refer to the direction which the predominant side 242 runs. For instance, vertically oriented rungs 240 may comprise predominant side 242 generally perpendicular with distal end 202 and/or proximal end 204. Similarly, horizontally oriented rungs 240 may comprise predominant side 242 generally parallel with distal end 202 and/or proximal end 204. It is noted that such labels (e.g., horizontally oriented, vertically oriented, etc.) are employed for clarity of explanation. As such, various other nomenclatures may be utilized to describe a relative orientation of rungs 240. Moreover, it is noted that rungs 240 may be other than perpendicular and/or parallel with distal end 202 and/or proximal end 204. In another aspect, distal end 202 and/or proximal end 204 may be irregular in shape.

Rungs 240 may be at least partially separated or defined by insulating areas 246. The insulating areas 246 may comprise an area that does not comprise PG and/or comprises an electrically insulating material. For instance, the insulating areas 246 may comprise PBN, air (e.g., no material), or the like. In an aspect, the insulating areas 246 may comprise an exaggerated bend 248. The exaggerated bend 248 may comprise an area that may comprise a triangular shape, circular shape or other shape as described herein. The circular shape, such as illustrated in FIG. 1A, may provide additional insulation in the subordinate side 244 where rungs meet.

Flange 230 may extend from body 210 proximal to proximal end 204. The flange 230 may extend generally perpendicularly from the body 210. In an aspect, the flange 230 may be generally planar or flat. For instance, the flange 230 may contact a surface (e.g., a floor) to support the body 210. The flange 230 may comprise one or more materials. In another aspect, the flange 230 may be divided into one or more portions that may not physically contact each other. The flange 230 may comprise similar materials as those of body 210 and/or may comprise disparate materials, such as metals, alloys, or the like. In an aspect, the flange 230 may comprise metals that are resilient over 1000° C.

According to at least one embodiment, flange 230 may comprise one or more apertures 232. The one or more apertures 232 may be configured to secure the heater assembly 200 to a surface. For instance, the apertures 232 may be configured to receive a bolt or other threaded member. In another aspect, the apertures 232 may be configured to receive an electrical contact from a power source, such as power mains, a battery, or the like. In an example, the apertures 232 may comprise an exposed portion of PG. The exposed PG may be in electrical contact with and/or comprise the PG layer of the body 210. Connection to a power source may allow for the flow of electrical power through the heating path 220. The electrical power may induce heat in the body 210, such as through resistance heating.

In an aspect, flange 230 may intersect and/or extend from body 210 proximal to a first portion of body 210 (e.g., lower body 236). Lower body 236 may be separated from a second portion of body 210 (e.g., an upper body 238, which may comprise rungs 240) by the horizontal insulating area 214. The horizontal insulating area 214 may comprise an electrical (e.g., dielectric) and/or heat isolating material. For example, horizontal insulating area 214 may comprise a material that may resist heat and/or may comprise poor heat transfer properties. The separation of the upper body 238 and the lower body 236 may prevent or cut-off heat flow between the upper body 238 and the lower body 236. Cutting-off of the heat transfer may reduce heat sink in the flange 230. As such, the heater assembly 200 may comprise a more uniform heat profile across upper body 238, may utilize less energy to heat a material, or may otherwise be more efficient with respect to other heaters. In an aspect, the horizontal insulating area 214 may comprise a width of less than 10 mm. In at least one example, the width may be about 2 mm.

Figure 3:
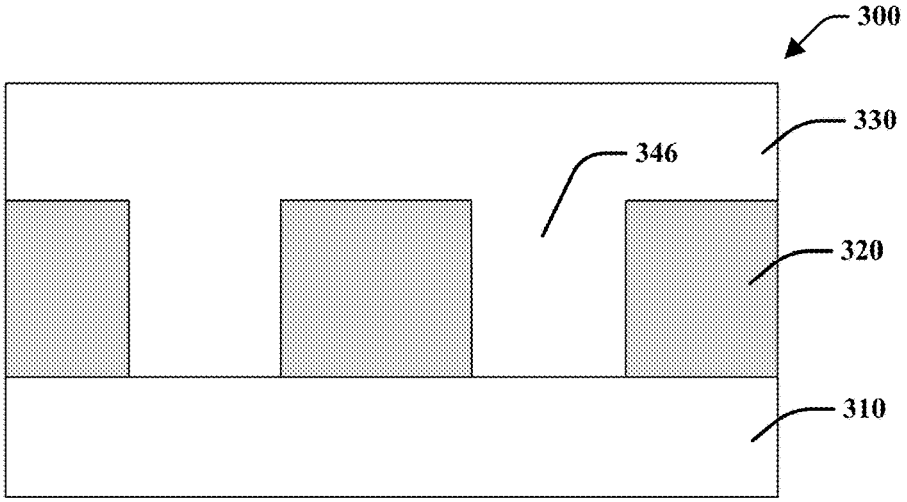
FIG. 3 illustrates a cross-sectional view of a heater assembly in accordance with an embodiment disclosed herein.
Figure 4:
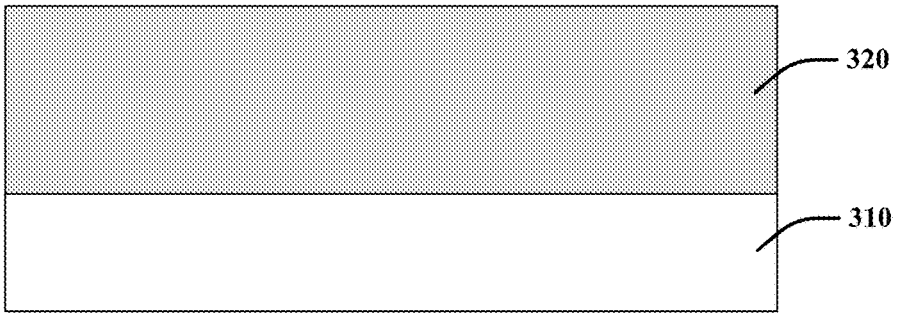
FIG. 4 illustrates a cross-sectional view of the heater assembly during fabrication in accordance with an embodiment disclosed herein.
Figure 5:
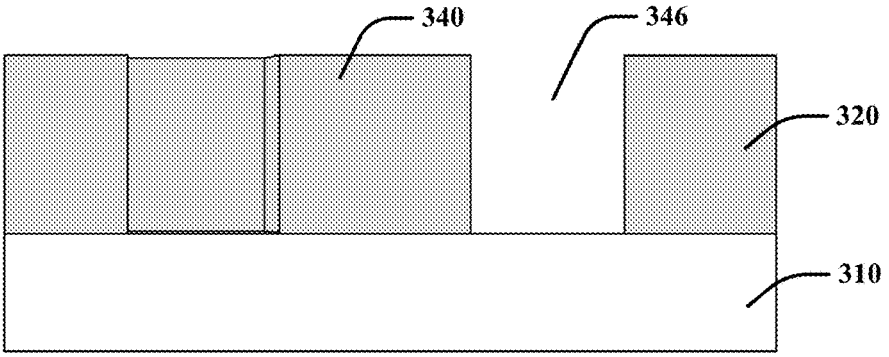
FIG. 5 illustrates another cross-sectional view of the heater assembly during fabrication in accordance with an embodiment disclosed herein.

FIG. 3 illustrates a cross-sectional view of a portion of a heater assembly 300. The heater assembly 300 may comprise similar aspects and/or properties as other disclosed heater assemblies. For instance, the cross-sectional view may comprise a portion of a body (e.g., upper body 238) of a heater assembly. The heater assembly 300 may primarily comprise a base layer 310, a core layer 320, and an overcoat layer 330. Turning to FIGS. 4 and 5, with reference to FIG. 3, illustrated are cross-sectional views of a portion of the heater assembly 300 during various stages of an exemplary manufacturing process. It is noted that the heater assembly 300 may be assembled, manufactured, or the like according to various other processes.

As shown in FIG. 4, base layer 310 may be provided. The base layer 310 may comprise a first coating layer or a portion of a coating layer. The coating layer may comprise at least one of a nitride, a carbide, a carbonitride, or an oxynitride of elements selected from a group consisting of B, Al, Si, Ga, refractory hard metals, transition metals, and rare earth metals, or a combination of two or more thereof. For instance, the base layer 310 may comprise at least one of PBN, aluminum nitride, titanium aluminum nitride, titanium nitride, titanium aluminum carbonitride, titanium carbide, silicon carbide, and silicon nitride. The base layer 310 may be provided in one or more shapes. For instance, the base layer 310 may comprise a generally hollow cylindrical shape, a polygonal shape, an irregular shape, or the like.

The core layer 320 may be deposited or otherwise provided on or in contact with the base layer 310. Core layer 320 may comprise a graphite core that may have a configuration defining a path for flow of electrical current. In an example, the core layer 320 may comprise PG for conducting electricity. The core layer 320 may be superimposed on the base layer 310 according to any appropriate means.

As shown in FIG. 5, the core layer 320 may be formed into a desired shape and/or pattern. For instance, the core layer 320 may be formed into a rung pattern, having predominant and subordinate sides. In another aspect, the path may comprise a path for flow of electrical current and/or a heating path (e.g., heating path 220). It is noted that the core layer 320 may be shaped according to at least one of mechanical etching, chemical etching, or the like.

As depicted, material of the core layer 320 may be removed to form rungs 340 and/or insulating areas 346. The rungs 340 may comprise areas defining a heating path as described herein. The insulating areas 346 may comprise one or more vias that may be formed through the core layer 320 to expose at least a portion of the base layer 310. It is noted that a portion of the base layer 310 may be removed to ensure complete removal of the core layer 320 in the insulating areas 346.

The insulating areas 346 may be filled with and/or comprise a dielectric, such as shown in FIG. 3. For instance, an overcoat layer 330 (e.g., a second coating layer) may be superimposed on the core layer 320 and/or at least a portion of the base layer 310. The overcoat layer 330 may comprise at least one of a nitride, a carbide, a carbonitride, or an oxynitride of elements selected from a group consisting of B, Al, Si, Ga, refractory hard metals, transition metals, and rare earth metals, or a combination of two or more thereof. For instance, the overcoat layer 330 may comprise at least one of PBN, aluminum nitride, titanium aluminum nitride, titanium nitride, titanium aluminum carbonitride, titanium carbide, silicon carbide, and silicon nitride.

It is noted that the heater assembly 300 may comprise other or different layers. For instance, the heater assembly 300 may comprise a different number of coating layers. According to at least one embodiment, the heater assembly 300 may comprise disparately formed layers that are attachably (e.g., removably or irremovably) assembled together. Such modifications are considered within the scope and spirit of this disclosure.

It is further noted that the heater assembly 300 may comprise various shapes and sizes. In at least one example, the coating layers (e.g., base layer 310 and/or overcoat layer 330) may comprise a general uniform coating of about 1 mm around the core layer 320. It is noted that the coating layers may or may not be uniformly superimposed about the core layer 320. It is further noted that the core layer 320 may or may not comprise a uniform thickness.

Figure 6:
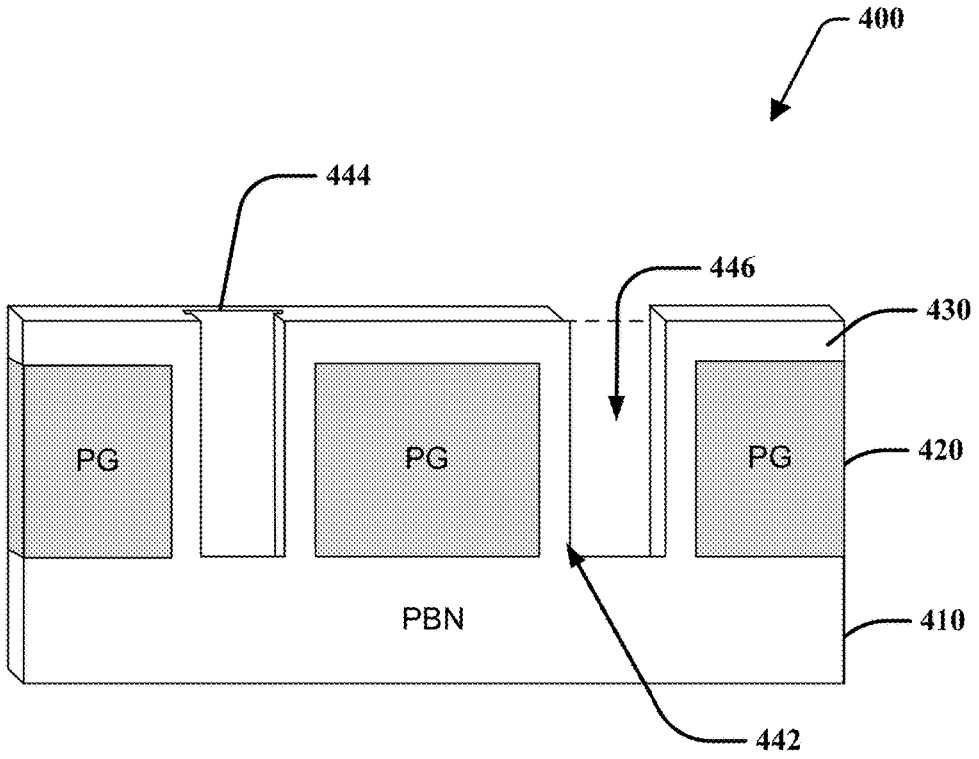
FIG. 6 illustrates a cross-sectional view of a heater assembly in accordance with an embodiment disclosed herein.

FIG. 6 is a cross-sectional view of a portion of a heater assembly 400 according to various disclosed aspects. It is noted that heater assembly 400 may comprise the same or similar aspects as various described embodiments. It is further noted that assembly 400 may comprise a portion of a larger assembly or system. For instance the heater assembly 400 may comprise at least a portion of a body of a heater assembly (e.g., body 210 of heater assembly 200).

Heater assembly 400 may primarily comprise a base layer 410, a core layer 420, and/or an overcoat layer 430. It is noted that the base layer 410 and/or the overcoat layer 430 may comprise similar or identical material. In an aspect, the base layer 410 and the overcoat layer 430 may be considered a single coating layer. The coating layer may comprise PBN and/or other appropriate material as described herein. In another aspect, the coating layer may encapsulate the core layer 420 to protect material of the core layer 420 from potentially corrosive atmospheres, provide structural integrity, or the like. For instance, the core layer 420 may comprise a graphite, such as PG, that may comprise an electrically conductive material. The graphite core may be susceptible to damage or degradation if exposed to certain chemicals or environments.

In an aspect, the cross-sectional portions of FIG. 6 may depict predominant sides 442 of the heater assembly 400. The predominant sides 442 may represent predominant sides of rungs of the heater assembly 400 (e.g., predominant sides 242). Subordinate sides 444 may connect the rungs to form a continuous path for electrical conduction and/or heating. The predominant sides 442 may be separated by one or more insulating areas 446. The insulating areas 446 may comprise areas substantially removed of material. In an aspect, outer walls of the overcoat layer 430 and/or the base layer 410 may comprise or define the insulating areas 446. In an aspect, the insulating areas 446 may be removed of material to achieve a desired heating profile of the heater assembly 400.

It is noted that the insulating areas 446 may comprise material, such as PBN, that may form supports between rungs. For instance, one or more PBN posts may span the insulating areas 446 to provide for structural integrity of the heater assembly 400. It is noted that various other embodiments may provide for similar or alternative designs within the scope and spirit of this disclosure.

Figure 7A:
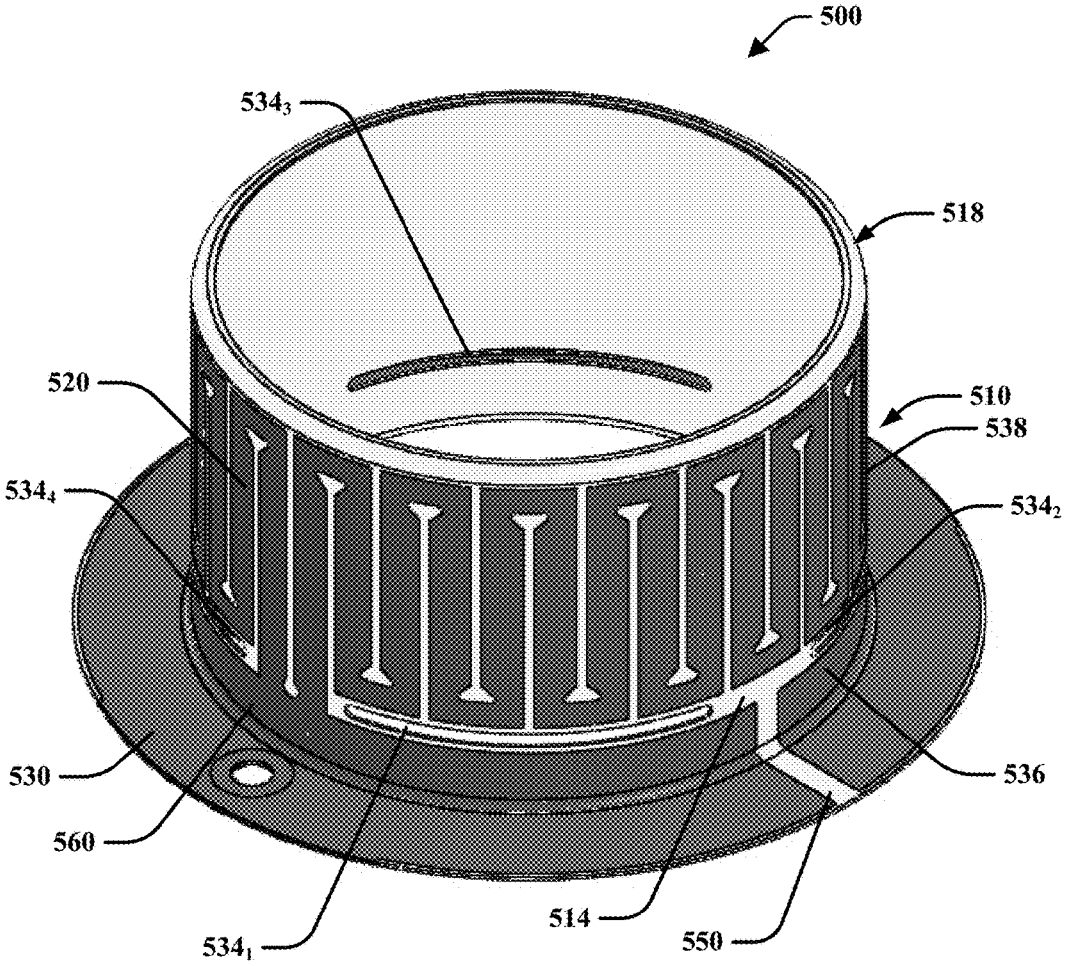
FIG. 7A is a perspective view of a heater assembly comprising exaggerated bends, a lip, and one or more slits in accordance with an embodiment disclosed herein.
Figure 7B:
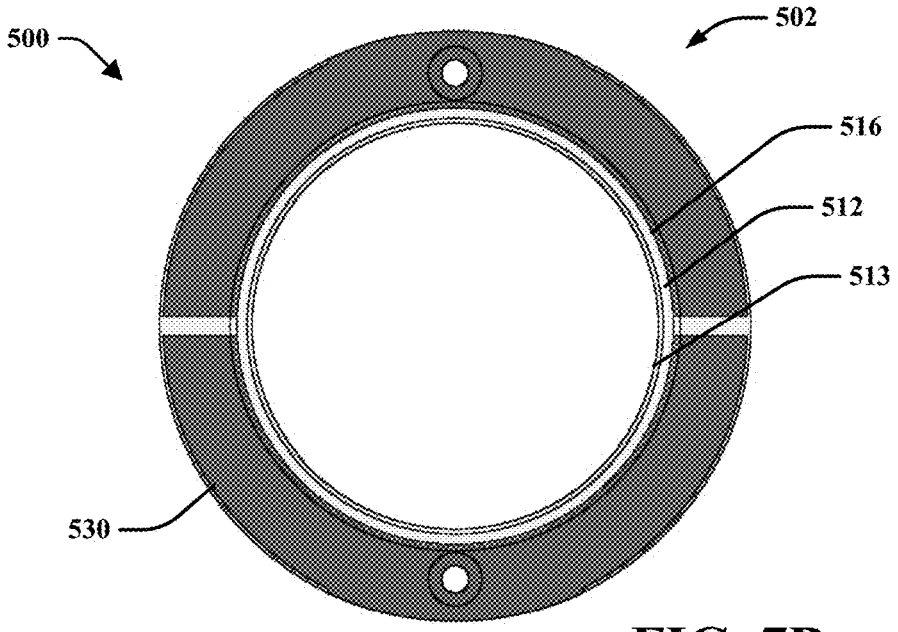
FIG. 7B illustrates a top view of the heater assembly of FIG. 7A.
Figure 7C:
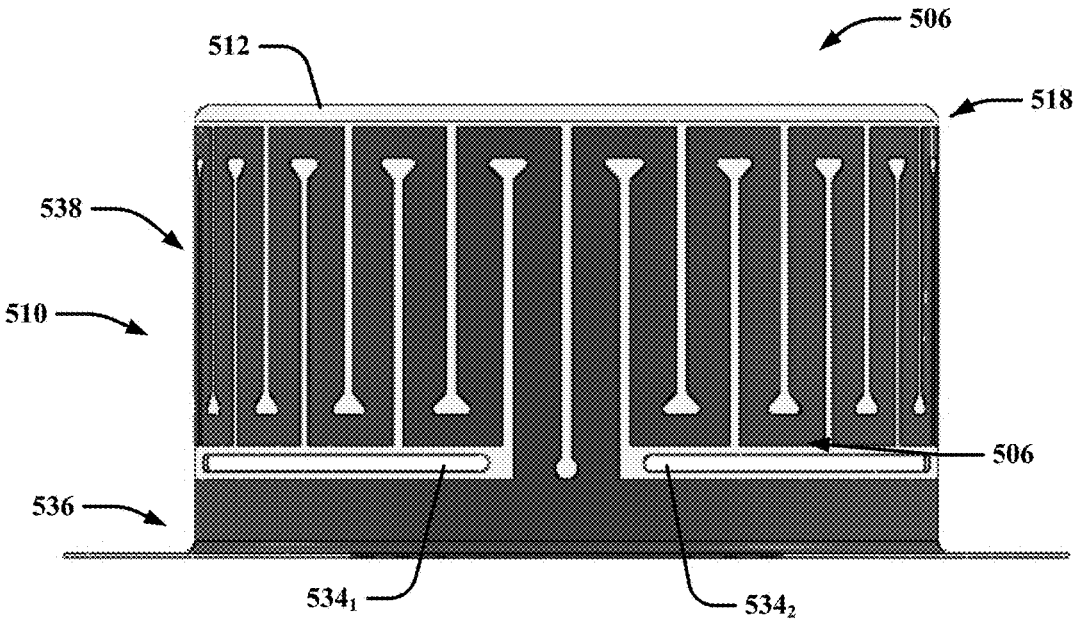
FIG. 7C illustrates a side view of the heater assembly of FIG. 7A.

FIG. 7A-C illustrate a heater assembly 500 in accordance with various described aspects. The plan view may depict a top plan view 502, a and a side view 506. In an aspect, the side view 506 may depict the side of a cylindrical body of the heater assembly 500 if it were straightened. As depicted, heater assembly 500 may comprise a body 510. The body 510 may comprise a lip 512 disposed at a distal end 518. The lip 512 may have an inner diameter 513 that is generally smaller than an inner diameter 516 of body 510. In an aspect, the lip 512 may be configured to receive a susceptor which may hold or support a wafer. The lip 512 may increase the radiation heat transfer to the susceptor in comparison with other heaters which may not comprise a lip. It is noted that the lip 512 may comprise one or more materials, such as any suitable metal or ceramic material as desired for a particular purpose or intended application. In an aspect, the lip 512 may comprise a non-conductor or a coating of a non-conductor. Examples of suitable ceramics may include, but are not limited to, silicon nitride, silicon carbide, aluminum nitride, aluminum oxide, beryllium oxide, boron nitride, etc.

The body 510 may comprise an upper body 538 that may comprise heating path 520 and a lower body 536. One or more slits $534_{1-4}$ may separate or provide a barrier between the upper body 538 and the lower body 536. The slits may be formed, for instance, through horizontal insulating areas 514. In an aspect, the one or more slits $534_{1-4}$ may comprise areas removed of material, such as removed of a graphite core or of any material. As depicted the body 510 may comprise a plurality of slits $534_{1-4}$, such as four slits $534_1$, $534_2$, $534_3$, and $534_4$. In an aspect, the slits $534_{1-4}$ may comprise apertures through the body 510. The slits $534_{1-4}$ may reduce heat transfer between the lower body 536 and the upper body 538. In at least one embodiment, the lower body 536 and/or the flange 530 may be held at lower temperatures than the upper body 538.

In embodiments, heater assembly 500 may comprise a base layer that may comprise PBN, a core layer that may comprise PG, and an overcoat layer that may comprise PBN. In an aspect, the heater assembly 500 may primarily comprise a cylindrical or tube-like body 510 and a base or flange 530. The body 510 may comprise a heating path 520 that may comprise a serpentine pattern and/or rungs. The body 510 may further comprise a lower body 536 and an upper body 538. Horizontal insulating areas 514 (and/or slits $534_{1-4}$) may separate portions of the lower body 536 from the upper body 538. While embodiments may be described as comprising one or more slits $534_{1-4}$, it is noted that embodiments may comprise other mechanisms for managing heat and/or reducing heat transfer between the lower body 536 and upper body 538. For instance, body 510 may comprise a plurality of apertures in a perforated-like pattern. In another aspect, the slits $534_{1-4}$ may comprise heat insulating material that may prevent or reduce transfer of heat between the upper body 538 and the lower body 536, while providing structural support for the upper body 538.

One or more horizontal insulating areas 514 may intersect at a support 550. It is noted that the support 550 may include one or more slits in a flange, as described herein. In another aspect, the support 550 may not container apertures, but may contain an insulating material. For instance, a dielectric and/or thermally insulating material may be utilized for support 550. The support 550 may be configured to provide thermal and/or electrical isolation while providing structural support for the upper body 538.

In an aspect, inner surfaces of the slits 514 may generally comprise an exposed portion of a coating layer, such as a PBN layer or the like. As such, a core layer (e.g., PG) may be isolated from potentially damaging or harmful atmospheres. In at least one embodiment, a PG layer may be exposed and/or coated with another material.

Figure 8:
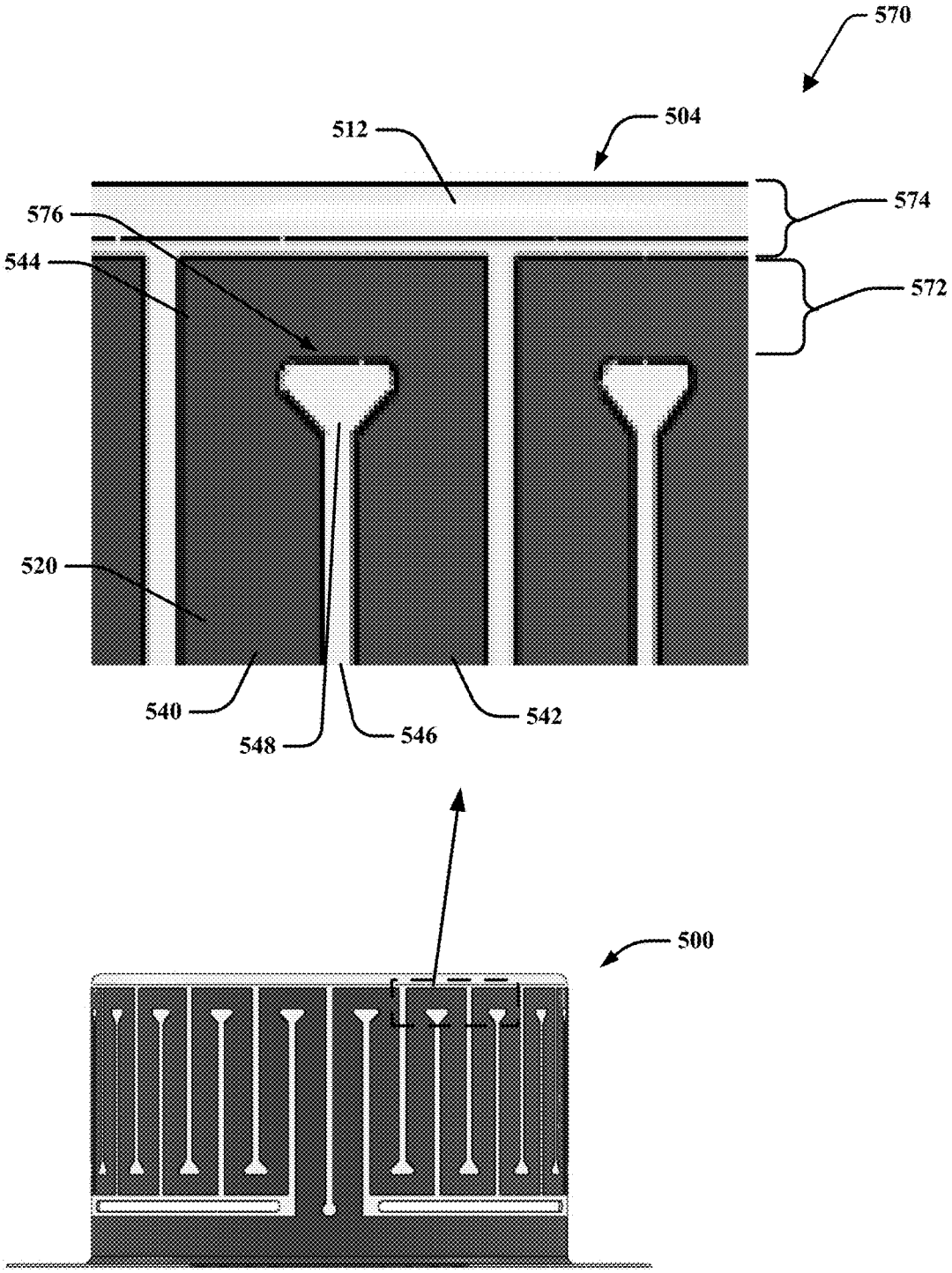
FIG. 8 illustrates an enlarged view of a portion for the heater assembly of FIG. 7A.

FIG. 8 depicts an enlarged view 570 of a portion of the heater assembly 500 in accordance with various described aspects. Enlarged view 570 depicts a portion of the heater assembly 500 near subordinate sides 544 of the heating path 520. As depicted, the subordinate sides 544 may eclectically connect a first predominant side 540 and a second predominant side 542. An insulating area 546 may be disposed between the first predominant side 540 and second predominant side 542 to define the heating path 520. An exaggerated bend 548 may comprise an area that may comprise a "T-like" or "Y-like" shape. The exaggerated bend 548 may provide additional insulation in the subordinate side 544. For instance, the exaggerated bend 548 may be configured to provide further separation where rungs meet to provide for a desired heating profile. In an example, the "T-like" or "Y-like" shape may control the heating profile and/or reduce hot/cold spots near subordinate sides 544. A lip 512 may be positioned above the subordinate sides 544 to receive a support, such as a susceptor support. In an aspect, the subordinate side 544 may be a first distance 574 from a distal side 502 of lip 512. For example, the subordinate side 544 may be between about 2-8 mm, such as 5 mm, from the distal side 502. In another aspect, the exaggerated bend 548 may comprise an end portion 576 that may be a second distance 572 from an end of the subordinate side 544. For instance, the second distance 572 may be between about 2-8 mm, such as about 5 mm. It is noted that the dimensions and/or configuration of the heating assembly 500 may vary depending on a desired application and/or heating profile.

Figure 9:
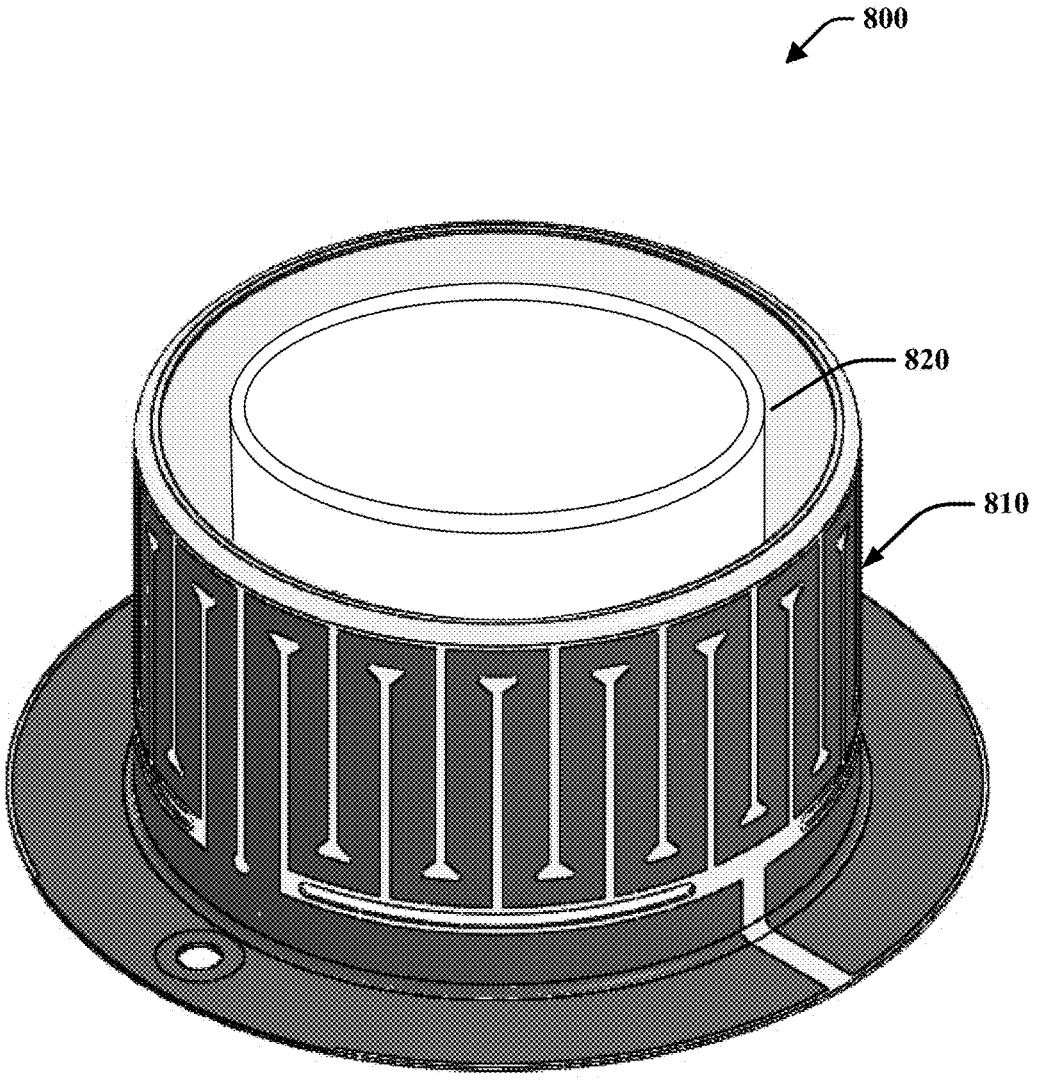
FIG. 9 illustrates a perspective view of another heater assembly and crucible in accordance with an embodiment disclosed herein.

FIG. 9 is an exemplary heating system 800. The heating system 800 may comprise a heater assembly 810 disposed within a crucible 820. The heater assembly 810 may comprise similar aspects as those described with reference to FIGS. 2-8. The crucible 820 may at least partially circumscribe the heater assembly 810 for a heating application.

Figure 10:
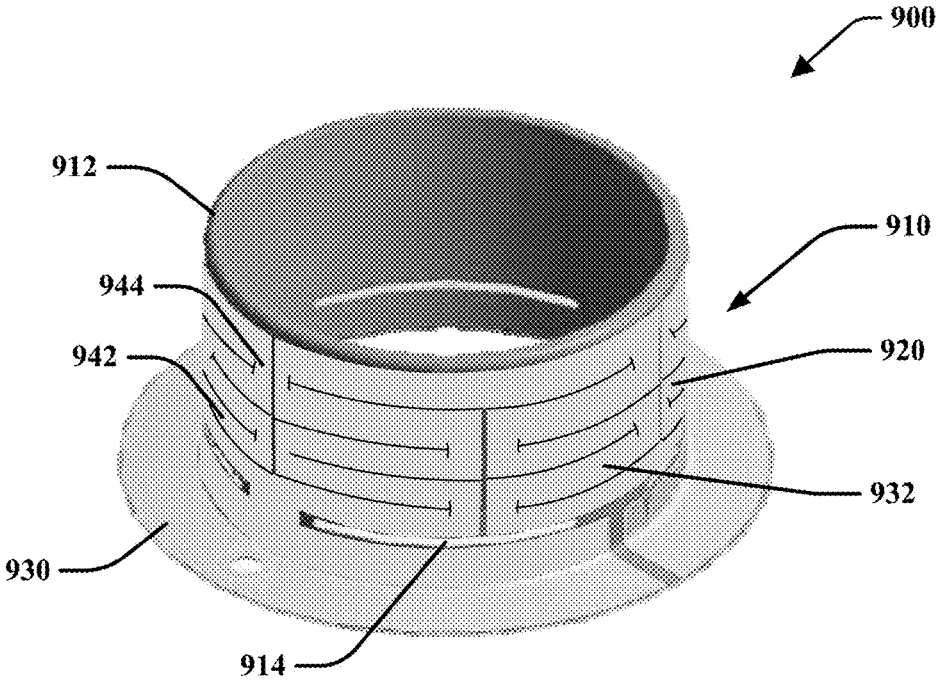
FIG. 10 illustrates a perspective view of a heater assembly comprising horizontally predominant rungs in accordance with an embodiment disclosed herein.

FIG. 10 illustrates a heater assembly 900 in accordance with various described embodiments. As depicted, the heater assembly 900 may include a body 910 having a flange 930 disposed at one end and a lip 912 disposed at a second end. The body 910 may comprise one or more materials, as described here as well as elsewhere in this disclosure. For instance, the body 910 may comprise a graphite core that may be surrounded by a coating layer, such as a PBN layer. The body 910 may comprise a heating path 920 that may comprise a desired pattern or design. For instance, the heating path 920 may comprise one or more rungs 932. The rungs 932 may comprise predominant sides 942 and subordinate sides 944. The predominant sides 942 may be arranged in a horizontal configuration. In an aspect, the body 910 may comprise one or more slits 914 disposed therethrough. The slits 914 may provide heat cutoffs or barriers to reduce heat transfer, such as from the body 910 to the flange 930. In an aspect, the reduced heat transfer may provide protection to an exposed portion of the heating path 920, such as a connection portion that may be connected to a power supply.

Figure 11A:
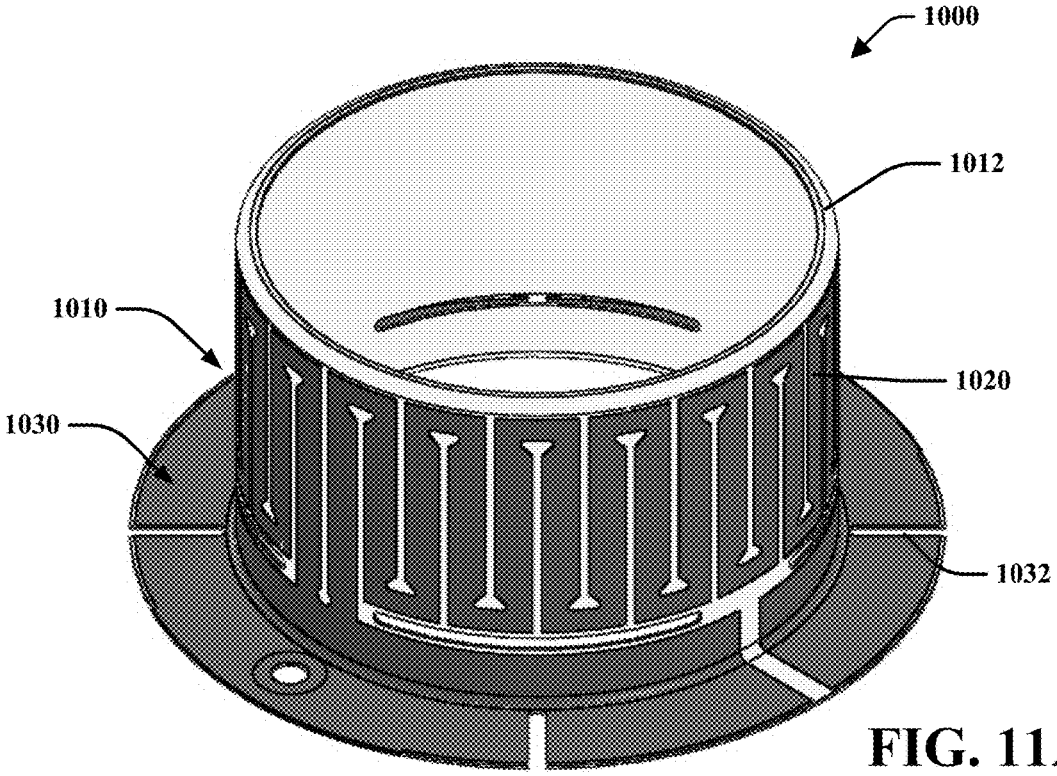
FIG. 11A illustrates a perspective view of another heater assembly comprising slits in a flange in accordance with an embodiment disclosed herein.
Figure 11B:
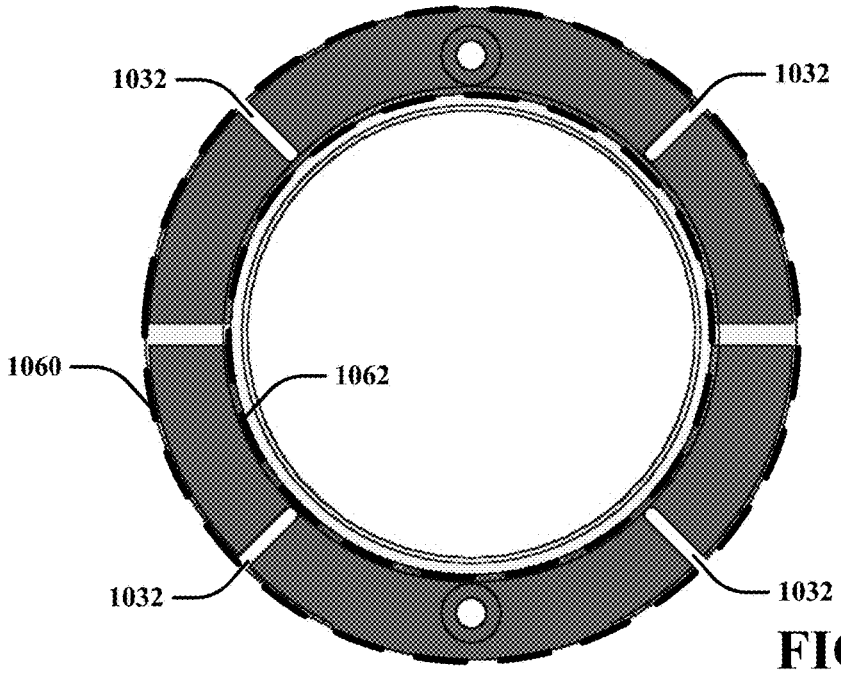
FIG. 11B illustrates a top view of the heater assembly of FIG. 11A.

FIGS. 11A-B illustrate a heater assembly 1000 comprising one or more slits in a flange. It is noted that the heater assembly 1000 may comprise similar aspects as those described with reference to the other figures. For instance, heater assembly 1000 may comprise a lip, slits in a horizontal insulating area, or the like. In an embodiment, heater assembly 1000 includes body 1010, flange 1030, lip 1012, and heating path 1020. The flange 1030 may include one or more slits 1032 formed there through. It is noted that the flange 1030 may include i slits 1032, where i is a number (e.g., 1, 2, 3, 4, etc.). Slits 1032 may allow for reduced stress in the flange due to heat. For example, heater assembly 1000 may be subject to intense heat. The heat may cause flanges to buckle, crimp, or deform. Slits 1032 may allow for stress relief and may allow material to expand, contract, or otherwise relieve stress due to heat.

Slits 1032 may extend from an outer perimeter 1060 of flange 1030 towards an inner perimeter 1062. While shown as extending generally the width of flange 1030, it is noted that the slits 1032 may extend from outer perimeter 1060 less than generally the width of flange 1030. In embodiments, slits 1032 may be spaced generally equidistant from each other, and may be similarly sized and shaped to each other. It is noted, however, that slits 1032 may be disposed in various locations and may be shaped differently from each other. In another aspect, while slits 1032 are described as being formed through the material of flange 1030, it is noted that the slits 1032 may comprise groves or the like. For instance, slits 1032 may be areas where material may be removed.

What has been described above includes examples of the present specification. It is, of course, not possible to describe every conceivable combination of components or methodologies for purposes of describing the present specification, but one of ordinary skill in the art may recognize that many further combinations and permutations of the present specification are possible. Accordingly, the present specification is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

EXAMPLES

Aspects of this disclosure will now be described and may be further understood with respect to the following examples. The examples are intended to be illustrative only and are to be understood as not limiting the invention disclosed herein in any way as to materials, or process parameters, equipment or conditions.

Figure 12A:
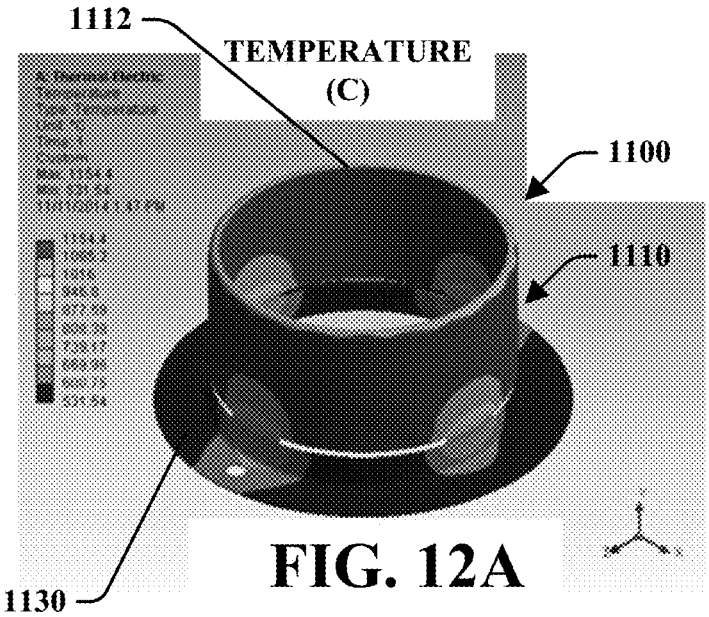
FIG. 12A is a graph illustrating temperature across a heater assembly comprising exaggerated bends and a lip in accordance with an embodiment disclosed herein.

In a first example, a heater assembly 1100 comprised a PG core encapsulated in a PBN coating, such as heater assembly 1100, etc. The heater assembly 1100 included a heating path and exaggerated bends similar to those of heater assembly 500. FIG. 12A shows measurements taken from the heater assembly. The flange 1130 of the heater assembly 1100 may be generally cooler than the body 1110. In another aspect, the body 1110 may be relatively stable in temperature. A lip 1112 may assist in managing heat to provide a generally stable and/or uniform heat across the lip 1112.

Figure 12B:
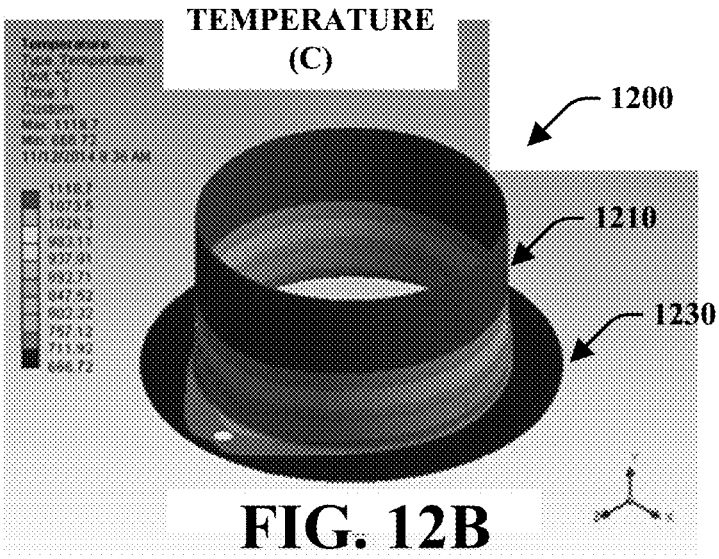
FIG. 12B is a graph illustrating temperature across a heater assembly without an exaggerated bend or a lip in accordance with an embodiment disclosed herein.

In a second example, a heater assembly 1200 did not comprise a lip or "T-shaped" exaggerated bends like those in FIG. 2. Rather, heater assembly 1200 included circular exaggerate bends, similar to those of heater assembly 100 of FIG. 1. The heating profile of the heater assembly 1200 was managed at least in part by a heating path. As can be seen in FIG. 12B, the heating profile was generally broken into sections or regions where heat was gradually dissipated proximal to the flange 1230. This resulted in body 1210 comprising a generally non-uniform temperature.

The foregoing description identifies various non-limiting embodiments of a heater assembly. Modifications may occur to those skilled in the art and to those who may make and use the invention. The disclosed embodiments are merely for illustrative purposes and not intended to limit the scope of the invention or the subject matter set forth in the claims.

What is claimed is:

1. A heater assembly comprising:

a body comprising:

a graphite core configured to define a heating path;

an overcoat layer encapsulating at least a portion of the graphite core; and at least one slit disposed in the body, the slit configured to cut-off heat transfer between a first portion of the body and a second portion of the body;

a flange disposed at a first end of the body; and wherein the heating path comprises at least two zones having a variable power density gradient through the length of each zone, where the variable power density gradient of the at least two zones is different from one another.

2. The heater assembly of claim 1, wherein the graphite core comprises a material chosen from carbon, graphite, carbon-bonded carbon fiber, silicon carbide, a metal, a metal carbide, a metal nitride, a metal silicide, or a combination of two or more thereof.

3. The heater assembly of claim 1, wherein the graphite core comprises a pyrolytic graphite and wherein the overcoat layer comprises a pyrolytic boron nitride.

4. The heater assembly of claim 1, wherein the heating path comprises a plurality of rungs.

5. The heater assembly of claim 4, wherein predominant sides of the rungs are generally vertical.

6. The heater assembly of claim 4, wherein the heating path comprises at least one exaggerated bend.

7. The heater assembly of claim 4, wherein the at least one exaggerated bend comprises at least one of a T-shape or Y-shape.

8. The heater assembly of claim 1, further comprising a lip disposed at a second end of the body.

9. A heater assembly comprising:

a cylindrical body having a proximal end and a distal end; and a heating path having rungs, the rungs comprising predominant sides oriented vertically between the proximal and distal end and subordinate sides oriented horizontally between the rungs, wherein the subordinate sides comprises at least one exaggerated bend, wherein the assembly comprises a lip disposed at the distal end, and the lip comprises an inner perimeter that has a length that is less than a length of an inner perimeter of a body of the heater assembly.

10. The heater assembly of claim 9, wherein the heating path comprises a graphite core.

11. The heater assembly of claim 10, wherein the heater assembly further comprises a pyrolytic boron nitride encapsulating at least a portion of the graphite core.

12. The heater assembly of claim 9, wherein the heater assembly further comprises a flange disposed at the proximal end.

13. The heater assembly of claim 12, wherein the heater assembly further comprises at least one slit separating at least a portion of the flange from at least a portion of the cylindrical body.

14. The heater assembly of claim 13, wherein the heater assembly comprises at least four slits.

15. A method of making a heater assembly, the method comprising:

providing a base layer;

superimposing a graphite core to the base layer;

forming the graphite core to define a heating path, wherein the heating path comprises at least two zones having a variable power density gradient through the length of each zone, where the variable power density gradient of the at least two zones is different from one another;

superimposing an overcoat layer over at least the graphite core, forming at least one slit disposed in the heater assembly, the slit configured to cut-off heat transfer between a first portion of the assembly and a second portion of the assembly; and providing a flange disposed at a first end of the assembly, wherein the base layer and the overcoat layer comprises a material chosen from a nitride, a carbide, a carbonitride, an oxynitride, B, Al, Si, Ga, refractory hard metals, transition metals, or rare earth metals or a combination of two or more thereof.

16. The method of claim 15, further comprising:

forming at least one aperture through at least the graphite core.

17. A method of heating a material comprising:

(i) providing a heater assembly proximate to a material to be heated, the heater assembly comprising:

a body comprising:

an upper end;

a lower end;

a graphite core defining a heating path, the heating path having a length oriented vertically between the upper and lower end; and at least one horizontal slit separating a first portion of the body from a second portion of the body; and a lip disposed proximal to the upper end; and (ii) positioning the material proximal to the lip.

18. The method of claim 17, further comprising:

heating the body to at least 1000° C.

19. A heater assembly comprising:

a body comprising:

a graphite core configured to define a heating path;

an overcoat layer encapsulating at least a portion of the graphite core; and at least one slit disposed in the body, the slit configured to cut-off heat transfer between a first portion of the body and a second portion of the body;

a flange disposed at a first end of the body; and a lip disposed at a second end of the body.

* * * * *